United States Patent [19]

Coats

[11] Patent Number: 5,042,817

[45] Date of Patent: Aug. 27, 1991

[54] BOMBER BOARD GAME AND METHOD OF PLAYING

[76] Inventor: Robert Coats, 205 Rue Grand, Lake St. Louis, Mo. 63367

[21] Appl. No.: 541,520

[22] Filed: Jun. 21, 1990

[51] Int. Cl.[5] ..... A63F 3/00

[52] U.S. Cl. ..... 273/255

[58] Field of Search ..... 273/242, 243, 250, 253, 273/255, 262

[56] References Cited

U.S. PATENT DOCUMENTS

| | | | |
|---|---|---|---|
| 47,867 | 5/1865 | Smith et al. | 273/262 |
| 1,526,602 | 2/1925 | Kuehn et al. | 273/255 X |
| 2,343,812 | 3/1944 | Sikora | 273/255 X |
| 2,414,165 | 1/1947 | Paschal | 273/262 |
| 4,055,346 | 10/1977 | Garcia-Kuenzli | 273/262 |
| 4,296,928 | 10/1981 | Nick | 273/262 |
| 4,572,514 | 2/1986 | Aponte | 273/255 |

FOREIGN PATENT DOCUMENTS

| | | | |
|---|---|---|---|
| 2002640 | 2/1979 | United Kingdom | 273/262 |
| 2202453 | 9/1988 | United Kingdom | 273/262 |

*Primary Examiner*—Edward M. Coven
*Assistant Examiner*—William E. Stoll
*Attorney, Agent, or Firm*—Veo Peoples, Jr.

[57] ABSTRACT

A game wherein a plurality of bomber pieces with associated bombs are moved upon a game board in opposition against a plurality of missile pieces until either the last missile or last bomber is destroyed. The board game apparatus includes coding of the bombs to match the initial starting positions of particular missiles, and a plurality radar paths defining movement for the missiles which paths interconnect with a single branched flight path that defines movement for the bombers.

8 Claims, 2 Drawing Sheets

BOMBER BOARD GAME AND METHOD OF PLAYING

BACKGROUND OF THE INVENTION

This invention relates generally to land-air battle board games and more specifically to those employing playing pieces that represent adversarial units, and defining patterns of movement that simulate alternative tactical air movements.

A number of games have been designed that attempt to simulate certain realistic but hypothetical situations. The games range from very simple to more complex. Many such games, however, because of their simplicity, do not appeal to a wide range of ages and lose their appeal after a certain period of play. The more complex games while being more challenging, suffer from being difficult to learn and from a limited cross-section of public to which the game appeals. It is therefore desirable to develop a game which has easily learnable basic moves, yet provides sufficient complexity and subtlety to appeal not only to the youngster but also to older, more sophisticated persons.

A few prior art games that simulate land air battles are for example U.S. Pat. Nos.

| | | |
|---|---|---|
| 2,293,398 | 4,003,578 | 4,120,503 |
| 2,794,641 | 4,004,810 | 4,185,832 |
| 3,191,937 | 4,016,939 | 4,280,704 |
| 3,404,889 | 4,057,253 | 4,572,514 |
| 3,779,553 | 4,078,805 | 4,801,148 |
| 3,809,408 | 4,093,236 | |

SUMMARY OF THE INVENTION

In accordance with present invention a land-air board game and method is provided in which playing pieces move in a specified manner, the opponents attempting to destroy one another.

The game board has a continuous path with simulated flight patterns for bombers, and a plurality of paths which simulate radar controlled guided missile flight and at least one cut-off path lower than the maximum simulated attitude of the bomber flight pattern. A plurality of missile launch pads are simulated for starting points of missile pieces. A single continuous looping path is provided for the bombers which may contain alternative forks in the path for strategic purposes.

It is an object of this invention to provide a method of play for an air-to-ground battle game, which game is easy to learn, yet provide a sufficient complexity and subtlety to appeal to a broad range of persons.

It is another object to provide a game wherein the playing pattern may be varied within predetermined constant paths to provide a plurality of distinct movements.

It is another object of the present invention to provide a game wherein the method of play may be altered slightly to provide additional complexity and subtlety as to number of players, and tactical considerations.

Other and further objects and advantages will be apparent to those skilled in the art upon a review of the following figures, Description and claims.

DESCRIPTION OF THE PREFERRED EMBODIMENT

The game board of the present invention may be constructed out of any durable material. A rigid, heavy weight paper material is suitable.

Figure 1:
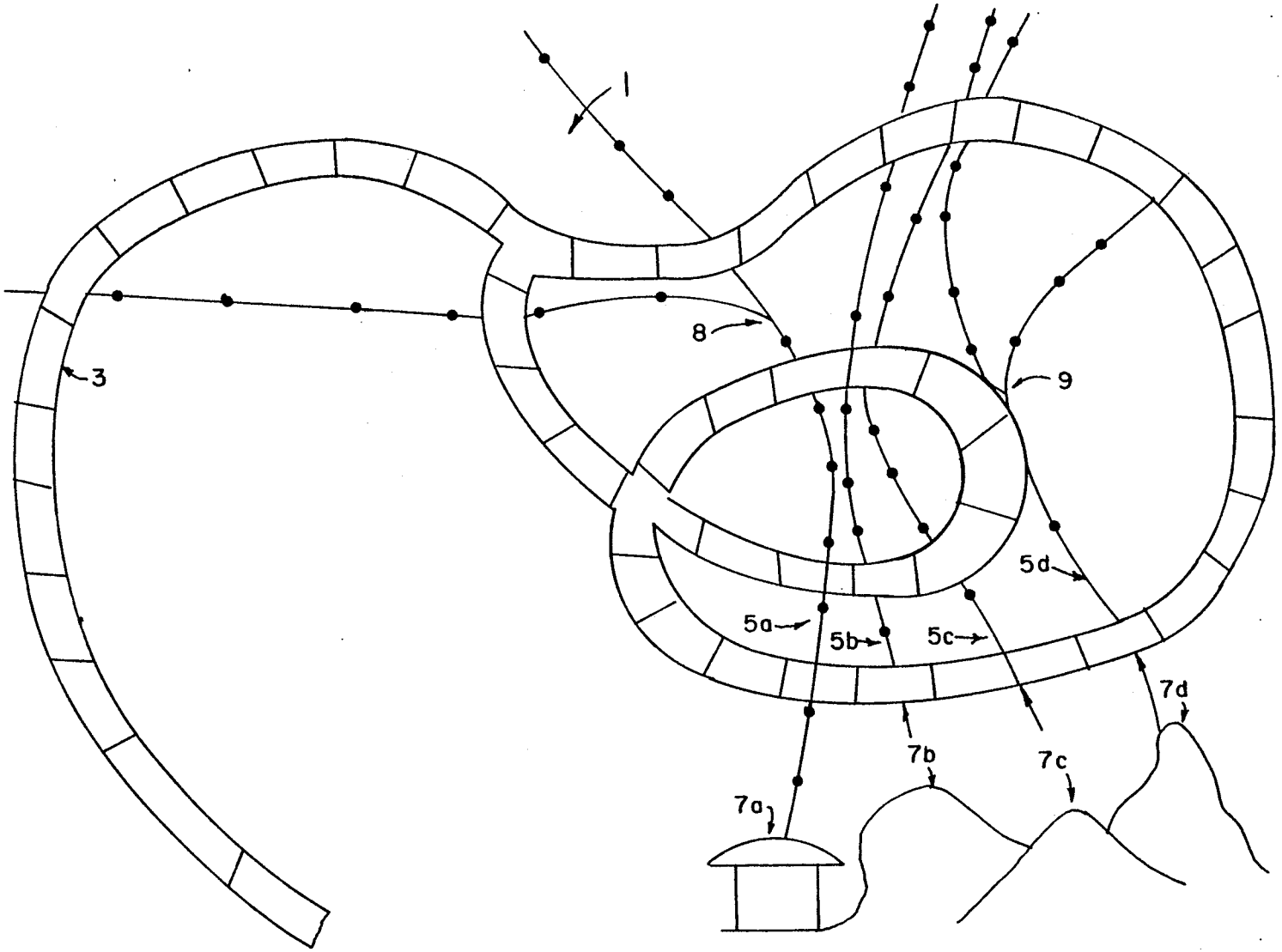
FIG. 1 in a plan view of the game board, showing the bomber starting position and flight path together with the missile silo launch pads and radar paths.

With reference to FIG. 1, shown is a game board 1, having a bomber starting position 2, and a bomber flight path generally designated as 3. The flight path 3 contains a series of consecutive spaces, for example 3*a* and 3*b*. The spaces each accommodate a resting place for movement of the bomber playing pieces 4. Several spaces have instructions such as 3*b* to "move back" or such as 3*c* to "drop bomb #1". The radar guided missile paths 5*a*, 5*b*, 5*c* and 5*d* are lines that define movement of missile pieces 6*a*, 6*b*, 6*c*, and 6*d* from the corresponding missile silo launch pads 7*a*, 7*b*, 7*c*, and 7*d*. In a preferred embodiment the guided missile radar paths branch at for example 8 and 9 prior to the maximum altitude or height of the bomber flight path 3.

Figure 2:
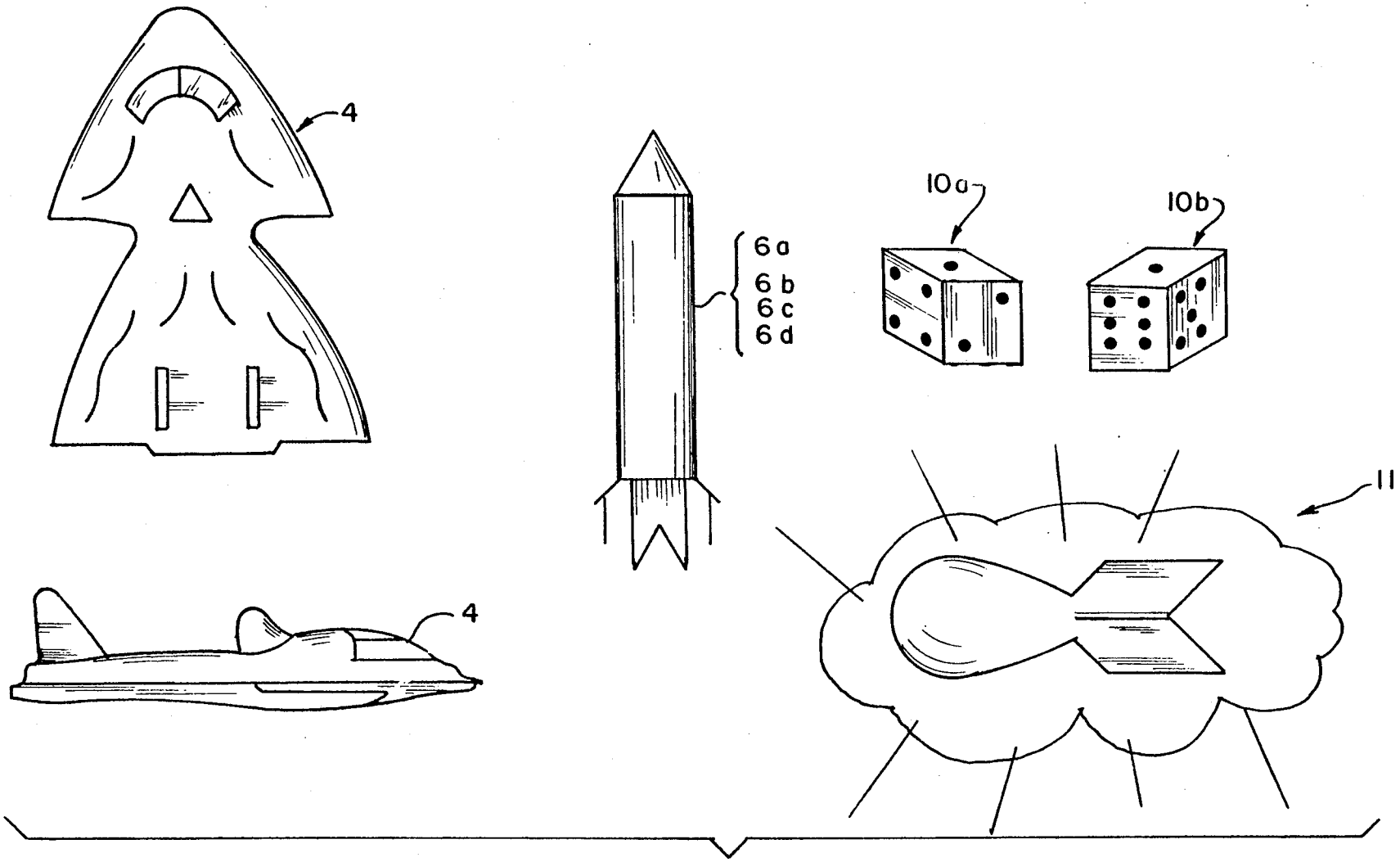
FIG. 2 shows the design of the various playing pieces.

Referring now to FIG. 2, the preferred embodiment of the game of this invention uses a plurality bomber pieces 4 which preferably have different colors which may then correspond to the color of particular silos 7*a*, 7*b*, 7*c*, or 7*d* for each in association with the bombing mission. A plurality of missiles 7 are also used. The missiles may also be colored to correspond with individual silos. The dice 10*a* and 10*b* may be different colors and any plurality desired to correspond to the colors of the bombers. The exploding bomb tokens 11 are provided in a plurality of colors to correspond to the color of the missile silo which it is assigned to destroy. In the method of playing the game of this invention one or more players may comprise a bomber squadron selecting one or more bomber pieces 4 that are placed at the starting position 2. The player or players constituting the bomber squadron holds one or more exploding bomb tokens 11 each corresponding to the mission of the selected bomber 4 to destroy a particular missile silo 7*a*, 7*b*, 7*c* or 7*d*.

The opposing player or players may comprise a missile launch crew who select one or more missile pieces 6*a*,6*b*, 6*c*, or 6*d* corresponding to an assignment to destroy one or more bombers 4. The missiles are placed in the missile silo launch pad preferably corresponding in color to the assigned missile.

The dice are rolled in alternating fashion, first by the bomber squadron and then by the missile crew. The bombers can begin and continue the game at the same time by rolling the dice simultaneously or they can start one at a time, alternating with the missiles depending upon the complexity desired by the players. However the missiles may only be launched simultaneously if limited to two missiles or consecutively if one at a time so long as a bomber squadron movement or throw of the dice alternates with the missile crew movement or throw of the dice.

The missile and bomber movement are determined by the number of spaces corresponding to a particular die according to the color of the die that corresponds with the particular playing piece.

The bombers move around the board over and over continuously, or back and forth if desired for additional complexity, observing the instructions on the board until they land on a space that instructs them to complete its designated mission of dropping its particular bomb on a corresponding missile silo. If a bomber lands on a space already occupied by another bomber preferably it is considered to be flying by and no impact occurs, although this method can be modified if desired. On the other hand a missile if landing on a space occupied by any bomber, or bombers does in fact destroy that bomber or bombers. Likewise, if a bomber lands on a space occupied by a missile, by exact count, the bomber is destroyed by pilot error. Unlike bombers, however, which once completing their particular mission have no further function on the board, the missiles will continue in flight and in movement until its silo has been destroyed.

Play continues until either all active silos have been destroyed or each bomber in flight has been destroyed, and the last remaining member of the bombing squadron or missile crew is considered the winner.

Obviously, variations in this game can be accorded such as awarding points to particular missiles, in order that a number of the missile crew who destroyed more planes even though being the first missile to be destroyed could become the winner of the game. Therefore, the invention is not to be limited by this description, but is of the full breadth and scope of the appended claims.

What is claimed is:

1. A method of playing an air-to-ground strategic bombing board game wherein opposing players under take either designated bombing missions or opposing designated guided missile assignments; the bombing missions being simulated by moving bomber playing pieces along a pattern of flight-path-playing-spaces, and the guided missile assignments being defined by moving missile playing piece from missile silo launch pads onto a pattern of radar-path-playing-spaces, in an attempt to destroy the bombers before the bombers destroy the missile silos, the method of play comprising the steps of:

a. each opposing player selecting one or more of either a predetermined number of bomber pieces or missile pieces;

b. then each bomber player also receiving one or more exploding bomb tokens, precoded to match a particular missile silo and all bomber pieces being placed on a single starting point;

c. each missile piece being coded to start from one of several missile silo launch pads and being placed thereon;

d. each player, then, in alternating turns, moving his playing piece, as follows:

(i) forward from its initial starting point, or in any direction from any subsequent space along its predesignated path a number of spaces in accordance with the roll of dice;

(ii) the bomber flight path, defining particular airplane diversionary tactics and at periodic intervals having various instructions appearing on its spaces, including from which point a particular coded bomb can be released, and the bomber player must follow the instruction appearing in the space on which it lands in accordance with the roll of the dice;

(iii) if the bomber piece lands on a space occupied by a fellow bomber piece it is unaffected by the presence of such piece but if it lands on a missile-occupied space, it is destroyed by pilot error; however (iv) if the missile piece lands or passes over a space occupied by a bomber piece the bomber piece is destroyed and it is removed from the board;

(v) if a bomber piece lands on the space having the instruction to drop that particular players coded bomb on the silo corresponding to that code, the bomb token is placed on the silo and that silo is destroyed;

(vi) continuing in this manner until either the bombers or missiles, complete each of their predesignated missions.

2. The method of claim 1 including the step of all bomber pieces being played by a single player.

3. The method of claim 1 including the step of all missile pieces being played by a single player.

4. The method of claim 1 including the step of each bomber piece being played by a separate player who together play as a team.

5. The method of claim 1 including the step of each missile piece being played by a separate player, who together play as a team.

6. A bomber boardgame comprising:

a plurality playing pieces representative of bombers;

a plurality of playing pieces representative of coded missiles;

a plurality of playing pieces representative of bombs each coded to correspond to a different one of the missiles;

a plurality of starting positions for said missiles on a board, each starting position coded to correspond to a different one of the missiles;

a single starting position on the board for the plurality of bombers;

a plurality of dice for randomly determining the amount of movement for the playing pieces;

the board further comprising a pattern of flight path spaces for movement of the bombers defined by a series of spaces within which alternatives are provided and wherein said spaces contain instructions periodically along the path;

the board still further comprising a plurality of separate radar path spaces for movement of the missiles all of which overlap the flight path pattern for the bombers at predetermined points.

7. The gameboard of claim 6 wherein the bomber flight pattern incorporates at least one loop and dive movement and 43 spaces on a continuous looping pathway.

8. The gameboard of claim 6 wherein the plurality of missile radar paths have at least one cutoff path beneath the maximum height of the bomber flight path.

* * * * *